US006145949A

United States Patent [19]

Takahashi

[11] Patent Number: 6,145,949

[45] Date of Patent: Nov. 14, 2000

[54] INK JET RECORDER

[75] Inventor: Yoshikazu Takahashi, Nagoya, Japan

[73] Assignee: Brother Kogyo Kabushiki Kaisha, Nagoya, Japan

[21] Appl. No.: 09/108,426

[22] Filed: Jun. 30, 1998

[30] Foreign Application Priority Data

Jul. 1, 1997 [JP] Japan ..... 9-176235

[51] Int. Cl.[7] ..... B41J 29/38

[52] U.S. Cl. ..... 347/14; 347/11

[58] Field of Search ..... 347/10, 14, 9, 347/20, 47, 68, 29, 172, 11

[56] References Cited

U.S. PATENT DOCUMENTS

| | | | |
|---|---|---|---|
| 5,189,440 | 2/1993 | Takakuwa et al. | 347/172 |
| 5,477,245 | 12/1995 | Fuse | 347/10 |
| 5,485,179 | 1/1996 | Otsuka et al. | 347/14 |
| 5,502,469 | 3/1996 | Watanabe | 347/14 |
| 5,581,281 | 12/1996 | Fuse | 347/14 |
| 5,610,638 | 3/1997 | Courtney | 347/14 |
| 5,736,994 | 4/1998 | Takahashi | 347/14 X |
| 5,894,314 | 4/1999 | Tajika et al. | 347/14 |
| 5,907,336 | 5/1999 | Hayakawa | 347/29 |
| 5,946,006 | 8/1999 | Tajika et al. | 347/14 X |

FOREIGN PATENT DOCUMENTS

| | | |
|---|---|---|
| 3-227643 | 10/1991 | Japan . |
| 3-284951 | 12/1991 | Japan . |
| 4-151256 | 5/1992 | Japan . |
| 5-24199 | 2/1993 | Japan . |
| 9-29960 | 2/1997 | Japan . |
| 9-29961 | 2/1997 | Japan . |

*Primary Examiner*—Susan S. Y. Lee
*Attorney, Agent, or Firm*—Oliff & Berridge, PLC

[57] ABSTRACT

A recorder includes a recording head, which has an ink channel and a nozzle communicating with the channel. A driver can drive the head to eject ink from the channel out through the nozzle. A temperature detector detects one or both of ink temperature and ambient temperature. A memory stores different drive waveforms. Depending on the temperature detected by the detector, a controller selects one of the stored waveforms for predetermined recording density. The controller sends the selected waveform to the driver to control the ejection of ink from the head. Only by controlling the drive voltage, it was not possible to secure constant recording density at various temperatures. However, it is possible to do so by using one of the different waveforms. The waveforms may each include a first pulse for ejecting ink and a second pulse for damping the ink vibration in the channel.

15 Claims, 12 Drawing Sheets

Fig. 4A

1st DRIVE WAVEFORM (SMALL VOLUME)

| TEMP. (°C) | VOLTAGE (V) | DROPLET SPEED (m/s) | VOLUME (pl) | REFLECTION DENSITY | |
|---|---|---|---|---|---|
| 10 | 32.0 | 11.0 | 41.0 | 0.98 | |
| 15 | 30.0 | 10.5 | 39.0 | 1.02 | |
| 20 | 28.0 | 10.0 | 38.0 | 1.05 | C |
| 25 | 25.0 | 9.3 | 36.0 | 1.05 | C |
| 30 | 22.0 | 8.5 | 35.0 | 1.05 | C |
| 35 | 18.0 | 7.3 | 33.0 | 1.06 | C |
| 40 | 13.0 | 6.5 | 32.0 | 1.06 | C |

Fig. 4B

2nd DRIVE WAVEFORM (MEDIUM VOLUME)

| TEMP. (°C) | VOLTAGE (V) | DROPLET SPEED (m/s) | VOLUME (pl) | REFLECTION DENSITY | |
|---|---|---|---|---|---|
| 10 | 28.0 | 11.0 | 44.0 | 1.03 | |
| 15 | 26.0 | 10.0 | 42.0 | 1.05 | B |
| 20 | 24.0 | 9.5 | 41.0 | 1.05 | B |
| 25 | 21.0 | 8.8 | 39.0 | 1.07 | |
| 30 | 18.0 | 8.0 | 38.0 | 1.08 | |
| 35 | 14.0 | 6.8 | 36.0 | 1.09 | |
| 40 | 9.0 | 6.0 | 35.0 | 1.10 | |

Fig. 4C

3rd DRIVE WAVEFORM (LARGE VOLUME)

| TEMP. (°C) | VOLTAGE (V) | DROPLET SPEED (m/s) | VOLUME (pl) | REFLECTION DENSITY |
|---|---|---|---|---|
| 10 | 26.5 | 8.5 | 61.5 | 1.04 |
| 15 | 24.0 | 7.5 | 58.5 | 1.05 |
| 20 | 22.0 | 7.0 | 57.0 | 1.08 |
| 25 | 19.0 | 6.3 | 54.0 | 1.11 |
| 30 | 16.0 | 5.5 | 52.0 | 1.13 |
| 35 | 12.0 | 4.3 | 49.5 | 1.14 |
| 40 | 7.0 | 3.5 | 48.0 | 1.15 |

A

Fig. 4D

CONBINATION

| TEMP. (°C) | VOLTAGE (V) | DROPLET SPEED (m/s) | VOLUME (pl) | REFLECTION DENSITY | |
|---|---|---|---|---|---|
| 10 | 24.0 | 8.0 | 61.5 | 1.04 | |
| 15 | 26.0 | 10.0 | 42.0 | 1.05 | A |
| 20 | 24.0 | 9.5 | 41.0 | 1.05 | B |
| 25 | 25.0 | 9.3 | 36.0 | 1.05 | |
| 30 | 22.0 | 8.5 | 35.0 | 1.05 | C |
| 35 | 18.0 | 7.3 | 33.0 | 1.06 | |
| 40 | 13.0 | 6.5 | 32.0 | 1.06 | |

10°C ~ 15°C: 3rd DRIVE WAVEFORM
15°C ~ 20°C: 2nd DRIVE WAVEFORM
20°C ~ 40°C: 1st DRIVE WAVEFORM

1st DRIVE WAVEFORM

2nd DRIVE WAVEFORM

3rd DRIVE WAVEFORM

Fig. 6A

TABLE 1

HIGH DENSITY

| No. | VOLTAGE (V) | WAVEFORM |
|---|---|---|
| 1 | 24.0 | 3rd WAVEFORM |
| 2 | 26.0 | 2nd WAVEFORM |
| 3 | 24.0 | 1st WAVEFORM |
| 4 | 25.0 | 1st WAVEFORM |
| 5 | 22.0 | 1st WAVEFORM |
| 6 | 18.0 | 1st WAVEFORM |
| 7 | 13.0 | 1st WAVEFORM |

Fig. 6B

TABLE 2

LOW DENSITY

| No. | VOLTAGE (V) | WAVEFORM |
|---|---|---|
| 1 | 22.5 | 3rd WAVEFORM |
| 2 | 24.5 | 3rd WAVEFORM |
| 3 | 22.5 | 2nd WAVEFORM |
| 4 | 23.5 | 2nd WAVEFORM |
| 5 | 20.5 | 1st WAVEFORM |
| 6 | 16.0 | 1st WAVEFORM |
| 7 | 11.5 | 1st WAVEFORM |

Fig. 8A

CONSTANT SPEED (1st DRIVE WAVEFORM)

| TEMP. (°C) | VOLTAGE (V) | DROPLET SPEED (m/s) | VOLUME (pl) | REFLECTION DENSITY |
|---|---|---|---|---|
| 10 | 31.0 | 9.3 | 34.0 | 0.96 |
| 15 | 29.0 | 9.3 | 34.5 | 1.00 |
| 20 | 27.0 | 9.3 | 35.0 | 1.03 |
| 25 | 25.0 | 9.3 | 36.0 | 1.05 |
| 30 | 23.0 | 9.3 | 37.0 | 1.07 |
| 35 | 21.0 | 9.3 | 38.5 | 1.09 |
| 40 | 19.5 | 9.3 | 40.0 | 1.11 |

Fig. 8B

CONSTANT VOLUME(2nd DRIVE WAVEFORM)

| TEMP. (°C) | VOLTAGE (V) | DROPLET SPEED (m/s) | VOLUME (pl) | REFLECTION DENSITY |
|---|---|---|---|---|
| 10 | 31.5 | 9.9 | 36.0 | 1.00 |
| 15 | 29.5 | 9.8 | 36.0 | 1.03 |
| 20 | 27.5 | 9.5 | 36.0 | 1.04 |
| 25 | 25.0 | 9.3 | 36.0 | 1.05 |
| 30 | 23.3 | 8.8 | 36.0 | 1.06 |
| 35 | 19.5 | 8.0 | 36.0 | 1.07 |
| 40 | 17.0 | 7.7 | 36.0 | 1.08 |

INK JET RECORDER

BACKGROUND OF THE INVENTION

1. Field of the Invention

The present invention relates to an ink jet recorder having a recording head for ejecting ink. In particular, the invention relates to an ink jet recorder capable of recording at substantially constant density regardless of temperature variation.

2. Description of Related Art

A known ink jet recorder like an ink jet printer includes a recording head, which has ink chambers or passages each defined between piezoelectric ceramic partition walls. One end of each passage is connected to an ink cartridge or another ink supply means. The head also has nozzles each communicating with the other end of one of the passages. In accordance with print data, the walls can be deformed to change the volume of the passages. When the volume of each passage decreases, ink is ejected in the form of a droplet from the passage through the associated nozzle onto a recording medium. When the volume of each passage increases, ink is supplied from the associated cartridge to the passage.

The viscosity of ink varies with ambient temperature. Therefore, if the drive voltage for the piezoelectric walls is constant, the volume of ejected ink and the ink ejection speed increase as the ambient temperature rises. In this case, as the temperature rises, the recording density increases. This makes it difficult to print at constant density. The variation in recording density may make the recorder user feel bad.

SUMMARY OF THE INVENTION

In view of the foregoing problems, it is an object of the present invention to provide a recorder for recording at substantially constant density regardless of temperature variation.

For the purpose of reducing the variation in printing density with the ambient temperature, the inventor investigated the relationship between the printing density and the ambient temperature with factors of ink ejection speed and ink volume by controlling the drive voltage. FIG. 8A of the accompanying drawings shows the variation in the drive voltage when the drive voltage was controlled so as to keep the ink ejection speed constant under the various temperatures. FIG. 8B shows the variation in the drive voltage when the drive voltage was controlled so as to keep the volume of the ejected ink constant under the various temperatures. The reflection density in FIGS. 8A and 8B are equivalent or correspond to the recording density on a recording medium.

However, even though the drive voltage is controlled as stated above, the recording density still depends on the ambient temperature. Specifically, in the case shown in FIG. 8A, the volume of ink and the recording density increase as the temperature rises. In the case shown in FIG. 8B, the recording density increases as the temperature rises, even through the volume is controlled to be constant. The reason for the result in FIG. 8B is considered as follows.

The viscosity of ejected ink decreases as the temperature rises. If the viscosity of an ink droplet ejected onto a recording medium is relatively high, the droplet tends to be kept round by its surface tension. If the viscosity is relatively low, the droplet spreads on the medium. This relatively enlarges the area occupied by the droplet on the medium. An ink droplet occupying a larger area on a recording medium appears deeper or darker. If this droplet is detected by an optical detector, the optical density per unit area of the droplet is higher. Consequently, even if the droplets of ink are equal in volume, the density is higher at higher temperature.

The inventor also knows the following problem related to a recorder including a recording head relative to which a recording medium moves. In general, under the same conditions, the speed of an ink droplet ejected from a nozzle of the recording head depends on the drive voltage for ejecting ink. If the speed is high, the ejected droplet may partially spray or splash from the nozzle, and may deviate from the right direction of ejection. If the speed is low, the droplet may be divided into a larger main droplet and smaller droplets. The smaller droplets are called satellites. Because the satellites reach the moving medium later than the main droplet, they are dislocated from the right or desired recording position on the medium. It is therefore obvious that the voltage is limited to maintain good recording.

From the foregoing facts, it will be understood that, even if the drive voltage is merely varied, it is difficult to obtain constant recording density at various temperatures.

In U.S. patent application Ser. No. 08/680,690 and the corresponding Japanese Patent Application Laid-Open Nos. 9-29960 and 9-29961, the inventor discloses a shear mode type ink ejector, which has ink passages and actuators. In order to reduce the residual pressure fluctuation in the passages, the waveform of the voltage for driving the actuators has been improved. The improved waveform includes a first pulse for ejecting ink and a second pulse for damping the vibration of the ink in the passages to make the next ejection better. The timing and width of the second pulse are limited to predetermined ranges. The publication discloses that it is possible to improve the quality of print by preventing the ink ejection speed from fluctuating with the drive frequency. However, the publication is silent about the relationship between the waveform and the ejected ink density, which depends on temperature.

According to further experiments of the inventor, it is not possible to maintain good printing at every temperature with the waveform in which the second pulse of this waveform has predetermined timing and width disclosed in the publication. It is desirable that the excellent technique for controlling the residual pressure fluctuation in the ink passages be able to be used regardless of temperature variation.

With the foregoing background, the present invention has been accomplished.

The disclosure of U.S. patent application Ser. No. 08/680,690 and the corresponding Japanese Patent Application Laid-Open Nos. 9-29960 and 9-29961 is incorporated herein by reference.

In accordance with the invention, a recorder is provided for recording by ejecting ink onto a recording medium. The recorder includes a recording head, which has an ink channel and a nozzle communicating with the channel. A driver can drive the head to eject ink from the channel out through the nozzle. A temperature detector detects one or both of ink temperature and ambient temperature. Depending on the temperature detected by the detector, a controller selects one of drive waveforms so as to obtain predetermined (constant) recording density. The controller sends the selected waveform to the driver to control the ejection of ink from the head.

The controller selects a drive waveform suitable for the ambient temperature around the recorder or the temperature of the ink in the recorder. The waveform is so selected that the recording density may be constant regardless of the ambient temperature or the ink temperature. Therefore, the density can be always constant. Thus, by selecting one of the waveforms, it is possible to maintain good quality of print without producing a spray of ink and ink satellites, and without causing ink to deviate from the right direction of ejection, over the whole range of temperature within which the recorder may be used.

The drive waveforms may each include at least a first pulse for ejecting ink and a second pulse for ejecting no ink. The second pulse is generated at an interval from the first pulse. The second pulses of the waveforms may differ in one or both of the interval and width. In this case, by selecting the interval and width of each second pulse suitably, it is possible to damp the ink vibration generated in the channel of the recording head when ink is ejected from the head. As a result, the pressure waves generated by the preceding ejection of ink can be inhibited from affecting the next ejection. This can increase the recording stability at high speed.

The drive waveforms may differ in the volume of ejected ink. For instance, one of the waveforms may be selected for ejecting smaller volume of ink as the detected temperature rises. Such control is based on the foregoing fact that, even if the volume of ejected ink is constant, the recording density increases as the temperature rises.

The drive waveforms may include at least a first waveform, a second waveform and a third waveform. The first pulses of the first and second waveforms may be equal in timing and width. The second pulses of the first and second waveforms may be different in one or both of the interval and width. By adjusting one or both of the interval and width of each second pulse, it is possible to control the volume of ejected ink.

The third waveform may further includes a third pulse for ejecting ink between the first and second pulses. This enables the third waveform to increase the volume of ejected ink in comparison with the first and second waveforms.

The controller may include a data table presetting combinations of temperatures and the drive waveforms. Otherwise, the recorder may further include a memory, which may store a data table presetting combinations of temperatures and the drive waveforms. The controller can easily select from the table the waveform suitable for the temperature. This can also reduce the burden on the controller, which may be a CPU. In the table, the temperatures, the drive waveforms and drive voltages may be associated.

The data table may include tables each for predetermined recording density. This enables the user to secure desired recording density at any ambient temperature. The recorder may further include a control panel, which may have a switch for the user to select the desired density.

Provided that the first pulse of each drive waveform has a width T, the middle of the second pulse of the waveform may range between 3.20 T and 3.75 T from the leading edge of the first pulse. This can make the speed of ejection constant at any drive frequency.

The first and second pulses of each drive waveform may be equal in amplitude. This makes it unnecessary to change the drive voltage. Therefore, the driver can be simple in structure and cheap.

The recorder may be effective as an ink jet printer or another type of recorder which includes a recording head having a piezoelectric actuator formed in it.

BRIEF DESCRIPTION OF THE DRAWINGS

A preferred embodiment of the invention will be described with reference to the accompanying drawings, in which:

FIGS. 4A, 4B and 4C are tables showing combinations of drive voltages and ink droplet ejection speeds for the three drive waveforms used for the recording head;

FIG. 4D is a table showing combinations, which can be used depending on ambient temperature, of the drive waveforms and drive voltages;

FIGS. 6A and 6B are tables of combinations of drive voltages and the drive waveforms;

FIG. 8A is a table showing drive voltages set for constant ink ejection speed regardless of ambient temperature according to the inventor's experimental result;

FIG. 8B is a table showing drive voltages set for constant volume of ejected ink regardless of ambient temperature according to the inventor's experimental result.

DETAILED DESCRIPTION OF A PREFERRED EMBODIMENT

Figure 1:
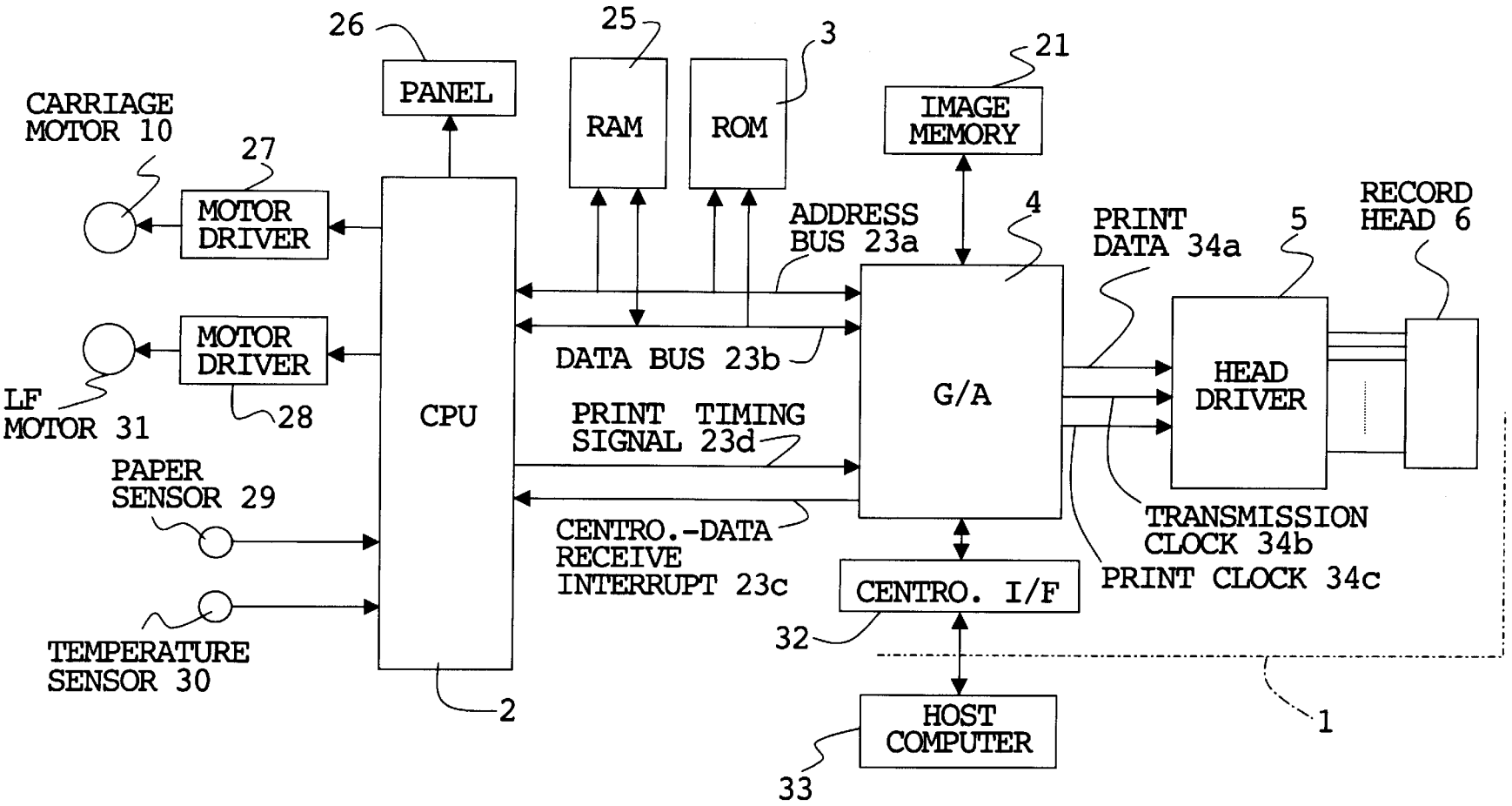
FIG. 1 is a block diagram of the control system of an ink jet recorder embodying the invention.

With reference to FIG. 1, an ink jet recorder 1 embodying the invention includes a CPU 2, as a controller, for controlling its operation. The recorder 1 also includes a ROM 3, as a controller or a memory, connected to the CPU 2. The ROM 3 stores data related to predetermined drive waveforms, which will be described later. The CPU 2 is connected through an address bus 23*a* and a data bus 23*b* to a gate array circuit 4, as a controller. The CPU 2 is connected through this circuit 4 to a head driver 5 and a recording head 6, which forms part of an ink ejector. The CPU 2, the ROM 3, the circuit 4 and the driver 5 form a drive for the ejector. The head 6 is mounted on a carriage (not shown).

The gate array circuit 4 is connected to an image memory 21 for storing print data temporarily, and implements data access to this memory 21. The CPU 2 is also connected to a RAM 25, a control panel 26, motor drivers 27 and 28, a paper sensor 29 and a temperature sensor 30, as a temperature detector. The RAM 25 stores programs temporarily. The panel 26 has a recording density selecting switch (not shown). The driver 27 drives a carriage motor 10. The driver 28 drives a line feed motor 31. The paper sensor 29 detects the presence or the absence of a recording medium. The temperature sensor 30 detects the temperature around the recording head 6. Necessary data are sent and received between or among these components.

The gate array circuit 4 is connected through a Centronics interface 32 to a host computer 33. The interface 32 sends 8-bit print data to this circuit 4. The circuit 4 outputs to the head driver 5 print data 34*a*, which is serial data, a transfer clock 34*b* and a print clock 34*c*. The clock 34*b* times the transfer of the print data. The clock 34*c* times the printing operation of the recording head 6. The gate array circuit 4 receives a print timing signal 23*d* from the CPU 2, and supplies an interrupt signal 23*c* to it. The timing signal 23*d* indicates that the head carriage has entered a range of constant speed and reached a print starting point. The interrupt signal 23*c* is related to the direct memory access, the data thinning or the like of the gate array circuit 4.

Figure 2A:
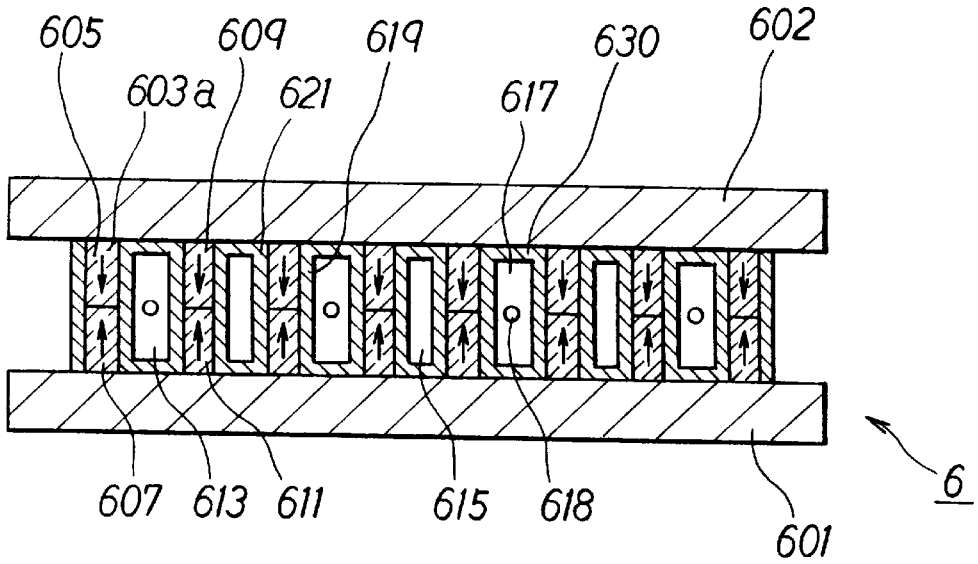
FIG. 2A is a vertical section of part of the recording head of the ink jet recorder.
Figure 2B:
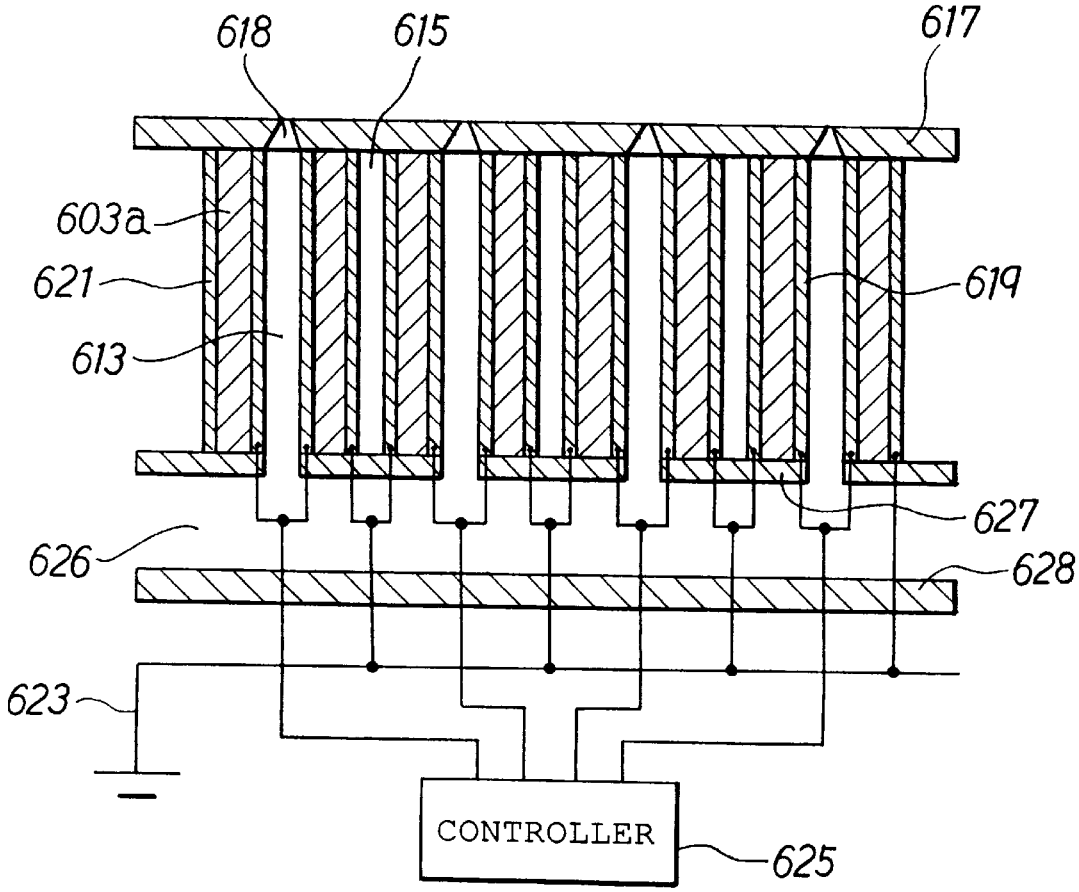
FIG. 2B is a horizontal section of this part of the recording head.
Figure 3:
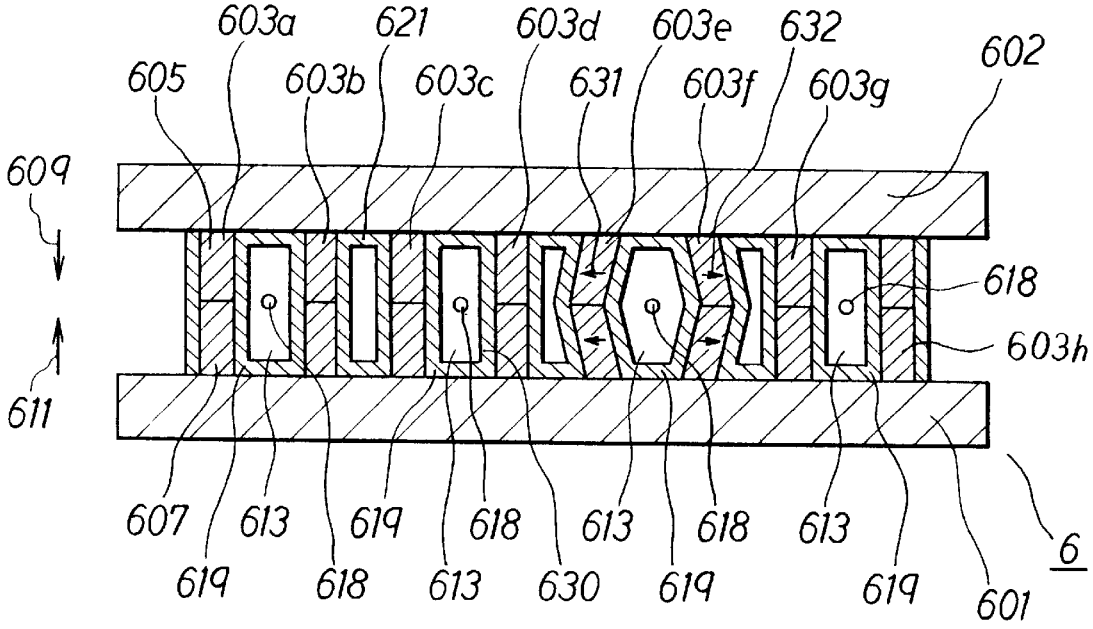
FIG. 3 is a vertical section of this part of the recording head, showing how the head operates to eject ink.

With reference to FIGS. 2A, 2B and 3, the ejection of ink by the ejector will be explained.

The recording head 6 includes a top wall 602, a bottom wall 601, and eight shear mode actuator walls 603*a*–603*h* between the walls 601 and 602. The actuator walls 603*a*–603*h* each include an upper part 605 and a lower part 607, which are made of piezoelectric material. The parts 605 and 607 are bonded to the walls 602 and 601 respectively, and polarized in the directions 609 and 611 respectively. The actuator walls 603*a*, 603*c*, 603*e* and 603*g* pair with the actuator walls 603*b*, 603*d*, 603*f* and 603*h* respectively to define an ink chamber 613 between each pair of actuator walls. The actuator walls 603*b*, 603*d* and 603*f* pair with the actuator walls 603*c*, 603*e* and 603*g* respectively to define a space 615 between each pair of actuator walls. The spaces 615 are narrower than the chambers 613.

The recording head 6 also includes a nozzle plate 617 fixed to its front end. The plate 617 has nozzles 618 formed through it and each communicating with one of the ink chambers 613. The rear ends of the chambers 613 are connected to an ink supply (not shown). The longer four sides of each chamber 613 are lined with an electrode 619. The longer four sides of each space 615 are lined with an electrode 621. The outer sides of the actuator walls 603*a* and 603*h* are each lined with an electrode 621. The electrodes 619 and 621 are metallized layers. The electrode 619 around each chamber 613 is coated with an insulating layer 630 for insulation from ink. The electrodes 619 of the chambers 613 are connected to a controller 625 for applying an actuator drive voltage. The other electrodes 621 are connected to a ground return 623.

When the controller 625 applies voltage to the electrode or electrodes 619 of one or more of the ink chambers 613, the actuator walls on both sides of this chamber or each of these chambers 613 deform piezoelectrically in such directions that the chamber or chambers enlarge in volume.

If, as shown in FIG. 3, a voltage of E volts is applied to the electrode 619 between the actuator walls 603*e* and 603*f*, for instance, electric fields are generated in the directions 631 and 632 in these walls 603*e* and 603*f* respectively. This deforms the walls 603*e* and 603*f* piezoelectrically in such directions that the associated ink chamber 613 enlarges, reducing the pressure in this chamber 613 to a negative pressure. The voltage is kept applied for a predetermined time T. While the voltage is applied, ink is supplied from the ink supply (not shown) to the chamber 613.

The predetermined time T is the one-way propagation delay time which it takes for the pressure wave in this ink chamber 613 to be propagated longitudinally of the chamber 613. The time T is the quotient of the division of the length L of the chamber 613 by the sound velocity V in the ink therein (T=L/V).

According to the theory of pressure wave propagation, the negative pressure in this ink chamber 613 reverses into a positive pressure when the time T passes after the voltage is applied to the associated electrode 619. When the time T passes after the voltage is applied to this electrode 619, the voltage is returned to zero volts. This allows the deformed actuator walls 603*e* and 603*f* to return to their original condition (FIGS. 2A and 2B), developing a positive pressure in the chamber 613. This pressure is added to the pressure reversed to be positive. As a result, a relatively high pressure develops near the nozzle 618 in the chamber 613, ejecting a droplet of ink through the nozzle 618.

In order that the recording density may be substantially constant regardless of the ambient temperature, the recorder 1 is controlled to use one of the drive waveforms selectively depending on ambient temperature variation.

In general, if the voltage is constant, the volume of each ejected ink droplet increases as the ambient temperature rises. The recording density increases with the droplet volume. Therefore, the recorder 1 is controlled to change over in order to a drive waveform for ejecting ink of larger volume as the temperature rises. For this purpose, the first, second and third drive waveforms shown in FIGS. 5A, 5B and 5C respectively are used. Each of the waveforms includes two or three pulses. The second pulses of the three waveforms differ in output timing and pulse width. By using one of the waveforms selectively depending on the ambient temperature, it is easy to control the volume of ejected ink. In order to damp the vibration generated in one or more of the ink chambers 613 by the ejection of ink, the output timing and the width of the last pulse of each waveform are predetermined as shown in FIGS. 5A–5C.

Returning to FIG. 3, immediately after the deformed actuator walls 603*e* and 603*f* start to return to their original condition, that is to say, just after ink starts to be ejected from the ink chamber 613 between them, there is a residual vibration in the ink in this chamber 613. By vibrating the walls 603*e* and 603*f* again at a predetermined time when there is a residual vibration in the ink, it is possible to suppress the vibration of ink. With such vibration timing and pulse width, it is possible to control the volume of the ink droplets ejected from the chamber 613. The timing and pulse width depend on the viscosity of ink. It is necessary to suppress the ink vibration properly, in order to form droplets of ink stably without their spraying while the walls 603*e* and 603*f* are driven in succession. The third drive waveform shown in FIG. 5C can eject two droplets of ink in succession. The droplets unite on a recording medium to increase the volume of ink. The last pulse of this waveform suppresses vibration as stated above. The detailed effect of the timing and the pulse width is disclosed in Japanese Patent Application Laid-Open Nos. 9-29960 and 9-29961.

Figure 5A:
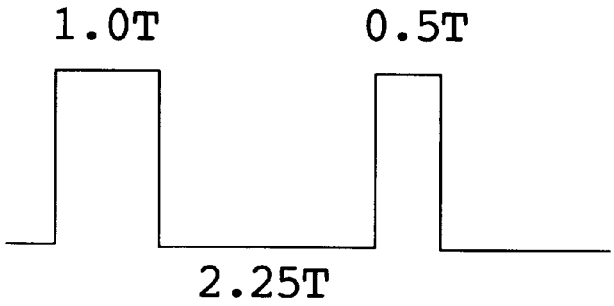
FIG. 5A shows the drive waveform for decreasing the volume of ejected ink.
Figure 5B:
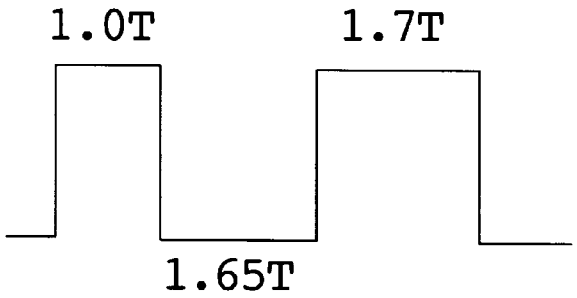
FIG. 5B shows the drive waveform for making the volume of ejected ink medium.
Figure 5C:
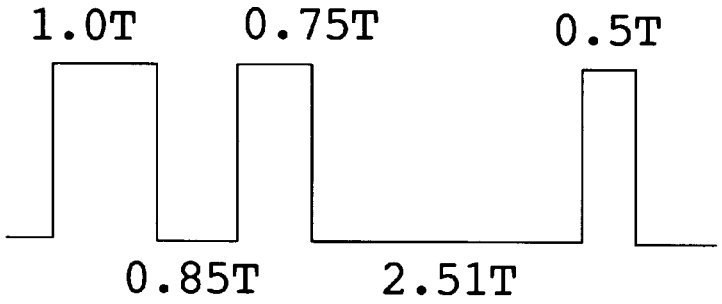
FIG. 5C shows the drive waveform for increasing the volume of ejected ink.
Figure 7A:
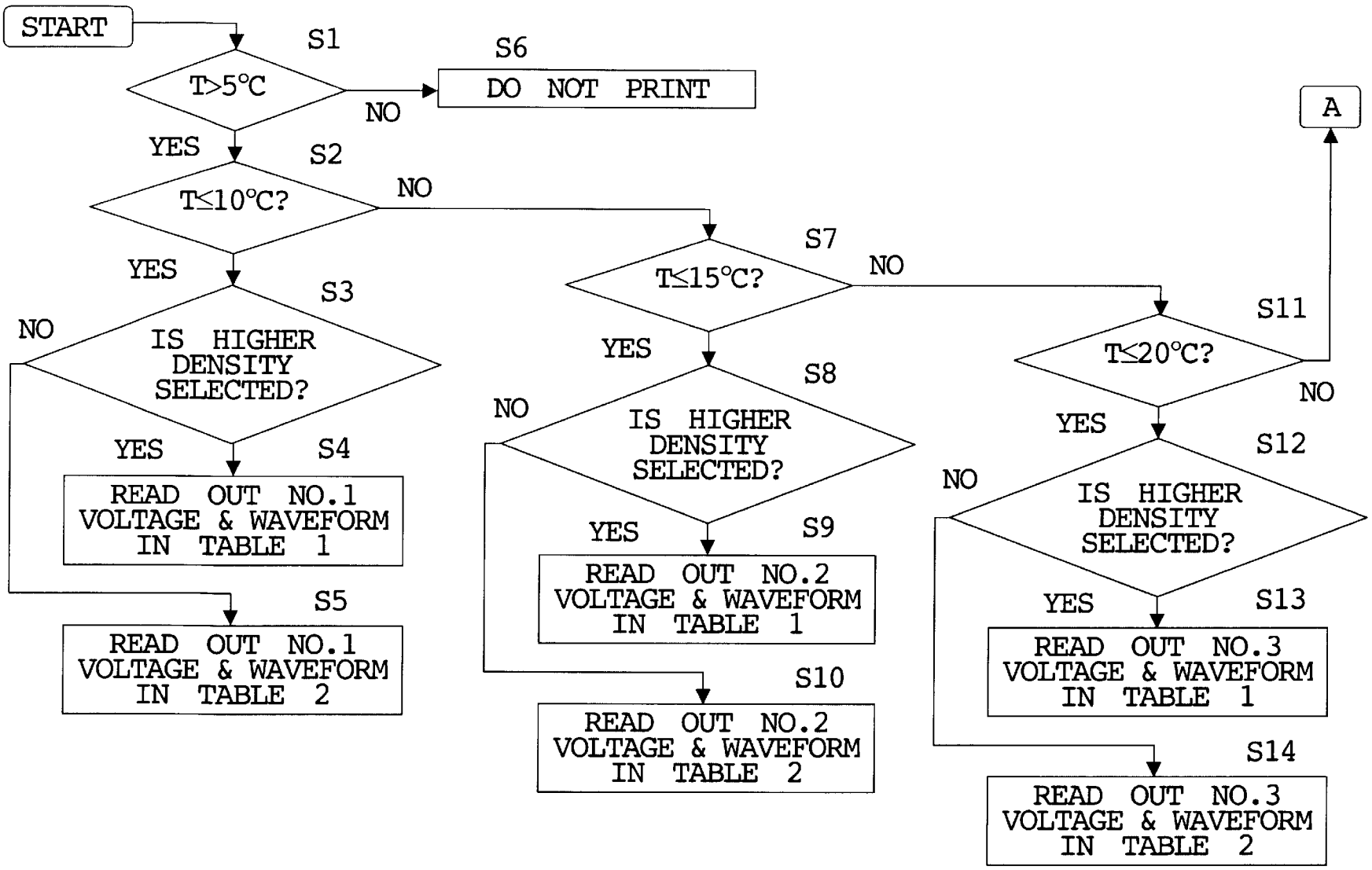
FIGS. 7A–7C are flowcharts of drive voltage and waveform selection control depending on ambient temperature in accordance with the invention.
Figure 7B:
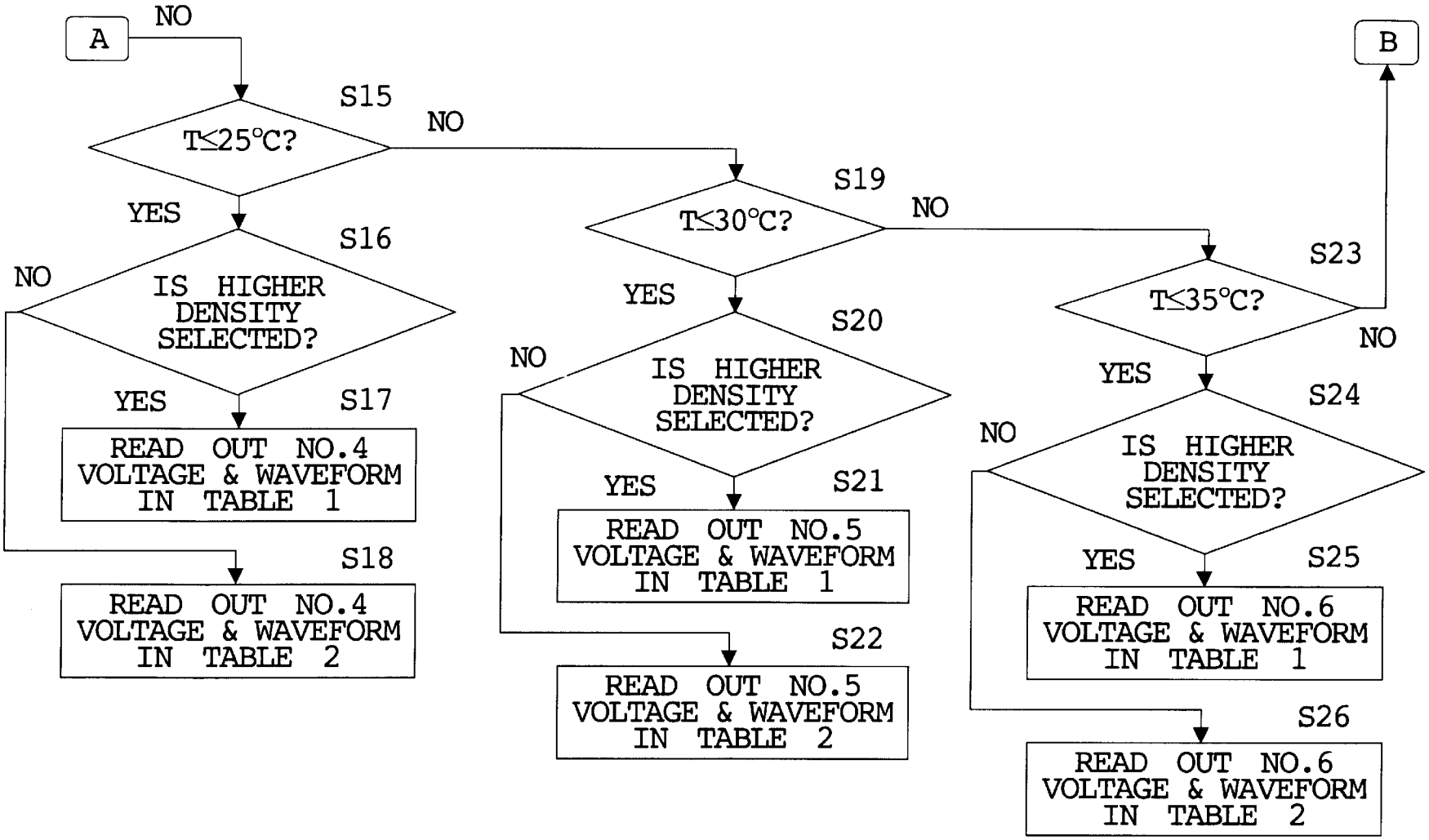
Figure 7C:
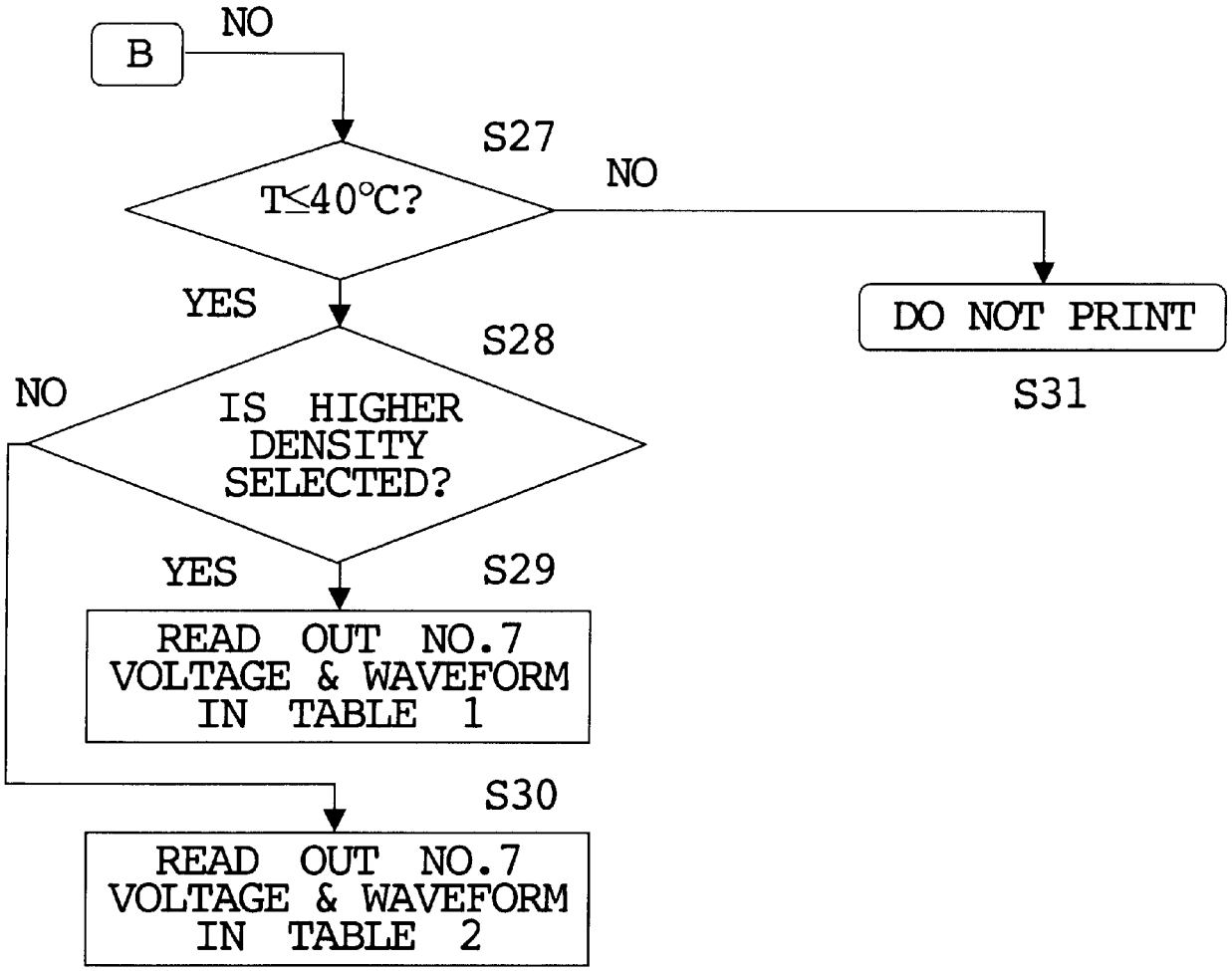

In FIGS. 5A–5C, the numerals represent the ratios of the pulse widths and intervals to the one-way propagation delay time T.

Experiments were made with the first, second and third drive waveforms to determine drive voltages for different temperatures. The ink droplet speed, the ink volume and the recording reflection density at each of the voltages were measured. The results of the measurement are shown in FIGS. 4A, 4B and 4C. FIGS. 4A–4C show that, as the temperature rises, the voltage of each waveform is lowered to minimize the increase in recording density. The third waveform makes the ink volume larger than the first does. For the same temperature, the voltage of the third waveform is lower than that of the first to minimize the increase in recording density.

In comparison between the range of temperature C shown in FIG. 4A of the first drive waveform, the range of temperature B shown in FIG. 4B of the second and the range of temperature A shown in FIG. 4C of the third, the recording density in each of the ranges is nearly equal to that of the others. Therefore, as shown in FIG. 4D, the recorder 1 may be controlled to drive the recording head 6 with the third waveform at ambient temperatures between 10 and 15 degrees C. (centigrade), the second waveform at ambient temperatures between 15 and 20 degrees C., and the first waveform at ambient temperatures between 20 and 40 degrees C. This makes the recording density substantially constant regardless of ambient temperature variation.

Table 1 of FIG. 6A is a data table prepared on the basis of the combinations of ambient temperatures and drive waveforms shown in FIG. 4D. By lowering the voltages in FIG. 4D or Table 1, it is possible to easily lower the recording density with each drive waveform. Table 2 of FIG. 6B is a data table of combinations of the waveforms and lower voltages. The combinations of drive voltages and waveforms in Tables 1 and 2 are stored in the ROM 3. By selecting a combination in one of Tables 1 and 2, it is possible to change the recording density.

With reference to FIGS. 6A, 6B and 7A–7C, an explanation will be made below of drive waveform selection control depending on the ambient temperature in accordance with the invention. When the recorder 1 starts to operate, the temperature sensor 30 detects the ambient temperature.

It is judged whether the detected temperature is higher than 5 degrees C. or not (S1), below or at which no print is possible. If the temperature is 5 degrees C. or lower (no at S1), no print is made (S6). If the temperature is higher than 5 degrees C. (yes at S1), it is judged whether the temperature is 10 degrees C. or lower (S2). If the temperature is 10 degrees C. or lower (yes at S2), it is judged whether the higher recording density is selected or not with the selecting switch of the control panel 26 (S3). If the higher density is selected (yes at S3), the No. 1 drive voltage and waveform in Table 1 are read out (S4). If this judgment results in no, it is determined that the lower density is selected (no at S3), and the No. 1 voltage and waveform in Table 2 are read out (S5).

If the detected temperature is higher than 10 degrees C. (no at S2), but equal to or lower than 15 degrees C. (yes at S7), it is judged whether the higher recording density is selected or not (S8). If the higher density is selected (yes at S8), the No. 2 drive voltage and waveform in Table 1 are read out (S9). If not (no at S8), the No. 2 voltage and waveform in Table 2 are read out (S10).

If the detected temperature is higher than 15 degrees C. (no at S7), but equal to or lower than 20 degrees C. (yes at S11), it is judged whether the higher recording density is selected or not (S12). If the higher density is selected (yes at S12), the No. 3 drive voltage and waveform in Table 1 are read out (S13). If not (no at S12), the No. 3 voltage and waveform in Table 2 are read out (S14).

Likewise, for every 5 degrees C. between the temperature above 20 degrees C. and 40 degrees C., it is judged whether the higher or lower recording density is selected. Depending on whether the density is higher or lower, the appropriate drive voltage and waveform of No. 4, 5, 6 or 7 are read out from Table 1 or 2.

If the detected temperature is higher than 40 degrees C. (no at S27), above which no print is possible, no print is made (S31).

The drive voltage and waveform thus read out are output from the CPU 2 to the head driver 5, which drives the recording head 6 at this voltage and with this waveform.

Thus, the recording density does not vary with the ambient temperature, and it is therefore possible to make recording always at substantially constant density.

Depending on the ambient temperature, the appropriate drive voltage and waveform are selected from the data tables in the ROM 3. By driving the recording head 6 at the selected voltage and with the selected waveform, it is possible to keep the recording density substantially constant. Therefore, the control for this can be simple.

As shown in the data tables of FIG. 6, the two groups of drive voltages are set for the drive waveforms depending on ambient temperature variation. It is therefore easy to make control for recording at desired density.

The invention is not limited to the foregoing embodiment, but various modifications may be made.

Instead of detecting the ambient temperature, the sensor 30 may be adapted to detect the temperature of the recording head 6, the temperature of the ink in the head 6, or any other temperature equivalent to the ink temperature.

In place of the three waveforms shown in FIGS. 5A, 5B and 5C, an arbitrary number of suitable waveforms might be used to drive the recording head 6.

Instead of setting the two groups or sets of drive voltages for each of the waveforms to control the recording density, it might be possible to set three or more groups of drive voltages. This widens the range of recording density for selection.

The recording head 6 may reciprocate for recording in both directions. In this case, ink is ejected for recording in one of the directions with timing different from that for recording in the opposite direction so that the print positions may be registered. For recording in each of the directions, the drive voltage may be controlled and the appropriate drive waveform may be selected, as stated above, depending on the ambient temperature. This makes equivalent effects for recording in both directions.

What is claimed is:

1. A recorder for recording by ejecting ink onto a recording medium, the recorder comprising:

a recording head having a nozzle for ejecting ink and an ink channel communicating with the nozzle;

a driver for driving the head;

a temperature detector for detecting at least one of ink temperature and ambient temperature; and a controller for controlling the ejection of ink from the head by selecting one of plural drive waveforms depending on the temperature detected by the detector, and by sending the selected waveform to the driver, wherein each of the drive waveforms includes at least a first pulse for ejecting ink and a second pulse for ejecting no ink, the second pulse being generated at an interval from the first pulse, and the second pulse of each waveform differing from the second pulses of the other waveforms in at least one of the interval and width.

2. The recorder as defined in claim 1, wherein the drive waveforms differ in volume of ejected ink.

3. The recorder as defined in claim 2, wherein one of the drive waveforms is selected for ejecting smaller volume of ink as the detected temperature rises.

4. The recorder as defined in claim 1, wherein the second pulse is a pulse for damping the ink vibration generated in a channel of the recording head when ink is ejected from the nozzle.

5. The recorder as defined in claim 1, wherein the drive waveforms include at least a first waveform, a second waveform and a third waveform, the first pulse of the first waveform equaling the first pulse of the second waveform in timing and width, the second pulse of the first waveform differing from the second pulse of the second waveform in at least one of the interval and width.

6. The recorder as defined in claim 5, wherein the third waveform further includes a third pulse for ejecting ink between the first pulse and the second pulse of the third waveform.

7. The recorder as defined in claim 1, wherein the controller includes a data table presetting combinations of temperatures and the drive waveforms.

8. The recorder as defined in claim 1, and further comprising a memory storing a data table presetting combinations of temperatures and the drive waveforms.

9. The recorder as defined in claim 8, wherein the data table includes tables each for certain recording density.

10. The recorder as defined in claim 9, and further comprising a switch for a user to select desired recording density.

11. The recorder as defined in claim 1, wherein the first pulse has a width T, the middle of the second pulse ranging between 3.20 T and 3.75 T from the leading edge of the first pulse.

12. The recorder as defined in claim 1, wherein the first and second pulses of each drive waveform are equal in amplitude.

13. The recorder as defined in claim 1, wherein the recording head further has a piezoelectric actuator formed therein.

14. The recorder as defined in claim 1, which is an ink jet printer.

15. The recorder as defined in claim 1, wherein each of the drive waveforms is associated with different temperatures so that a constant recording density may be obtained.

* * * * *